US008245559B1

(12) United States Patent
Warriner et al.

(10) Patent No.: US 8,245,559 B1
(45) Date of Patent: Aug. 21, 2012

(54) RADIAL COMPRESSION MECHANISM WITH OPTIMUM DIE-TO-DIE GAP

(76) Inventors: Jeremiah j. Warriner, Laveen, AZ (US); Ed Goff, Phoenix, AZ (US); Justin Knight, Tempe, AZ (US)

( * ) Notice: Subject to any disclaimer, the term of this patent is extended or adjusted under 35 U.S.C. 154(b) by 977 days.

(21) Appl. No.: 12/101,550

(22) Filed: Apr. 11, 2008

Related U.S. Application Data

(60) Provisional application No. 60/911,162, filed on Apr. 11, 2007.

(51) Int. Cl.

| | |
|---|---|
| ***B21D 41/00*** | (2006.01) |
| ***B21D 19/00*** | (2006.01) |
| ***B21J 7/16*** | (2006.01) |
| ***B21J 9/18*** | (2006.01) |

(52) U.S. Cl. ..... 72/402; 72/452.4; 29/516

(58) Field of Classification Search ..... 72/402, 72/409.09, 409.1, 452.1, 452.4, 452.2; 29/237, 29/508, 516

See application file for complete search history.

(56) References Cited

U.S. PATENT DOCUMENTS

| | | | | |
|---|---|---|---|---|
| 7,389,670 | B1 * | 6/2008 | Kokish et al. | 72/402 |
| 7,530,253 | B2 * | 5/2009 | Spenser et al. | 72/402 |
| 2008/0053182 | A1 | 3/2008 | Goff | |

* cited by examiner

*Primary Examiner* — Dana Ross
*Assistant Examiner* — Mohammad I Yusuf
(74) *Attorney, Agent, or Firm* — Parsons & Goltry; Robert A. Parsons; Michael W. Goltry

(57) ABSTRACT

Radial compression mechanism includes a housing defining an inner chamber and a central opening for insertion and removal of product. A plurality of elongated compression dies are movably mounted for reciprocal movement within the inner chamber and define a central product receiving cavity coaxial with the axis of the central opening. Cam followers are affixed to the dies. First cam surfaces are affixed relative to the housing and second cam surfaces are movably mounted relative to the housing. Each cam follower engages a first cam surface to define a first position control constraint, and a second cam surface to define a second position control constraint. Each die has a position relative to each adjacent die and the coaxial central cavity that is controlled by the first position control constraint and the second position control constraint.

20 Claims, 9 Drawing Sheets

RADIAL COMPRESSION MECHANISM WITH OPTIMUM DIE-TO-DIE GAP

CROSS REFERENCE TO RELATED APPLICATION

This application claims the benefit of U.S. Provisional Patent Application No. 60/911,162, filed 11 Apr. 2007.

FIELD OF THE INVENTION

This invention generally relates to radial compression mechanisms and more specifically to mechanisms for compressing devices such as stents, catheters, balloons, and the like.

BACKGROUND OF THE INVENTION

In the manufacture and testing of medical devices, mechanisms are used to radially compress cylindrical devices such as stents, balloons, and catheters. For example, installation of a stent onto a catheter balloon is typically done by compressing the stent radially inward onto the balloon with enough pressure to permanently deform the stent to a smaller diameter and to slightly embed the metal stent into the plastic balloon. In another example, a polymer catheter balloon is compressed radially after pleating to wrap it tightly around the catheter shaft. In another example, a self-expanding stent is radially compressed to insert it into a sheath or delivery system. In an example of medical device testing, a stent is radially compressed while the required force is measured, in order to measure the stent's functional relationship between diameter and radial force.

A first type of prior art device includes a radial compression mechanism wherein several similar wedge-shaped dies with planar surfaces are arranged to form an approximately cylindrical central cavity, the wedges being hinged and driven in unison to change the diameter of the cavity. A mechanism of this type is illustrated in FIGS. 1 through 5. Examples of this mechanism are the Crimpfox tool sold by Phoenix Contact GmbH 7 Co. KG (CRIMPFOX UD 6-6, Part Number 1206366), and the "segmental compression mechanism" marketed by Machine Solutions Incorporated, and described in U.S. Pat. No. 6,968,607. In this type of mechanism, the working surfaces of the dies have a wedge shape with two planar surfaces meeting at the tip. A shortcoming of this type of mechanism is that there exists a gap between adjacent wedges, the size of which varies with the diameter of the cavity in an undesirable way. Typically, the mechanism is specifically designed to provide a desired range of cavity diameters. At the lowest and highest diameters, the dies are tightly wedged against each other (zero gap). As the diameter is increased from the lowest, the gap increases until it reaches a maximum, then decreases until it becomes zero again at the highest diameter, as illustrated graphically in FIG. 5. The diameter range and gap (as a function of diameter) depend on the specific design of the mechanism, particularly the location of the hinge point of the dies and the diameter of the circle formed by all of the die hinge points in the mechanism. A larger diameter of the hinge point circle results in a smaller maximum gap for a given diameter range. The strict design tradeoffs for this type of mechanism results in a mechanism that must be large to provide a small maximum gap for a given diameter range, or a mechanism that must have a large gap to provide the same diameter range in a small size. Large gaps between the wedges are a disadvantage because they allow space for parts of the compressed device to go into. For example, the metal struts of a stent can move into the gap and be damaged.

A second type of prior art device includes a radial compression mechanism wherein several similar wedge-shaped dies with planar surfaces are arranged to form an approximately cylindrical central cavity, the wedges being attached to linear guides and driven in unison to change the diameter of the central cavity. A mechanism of this type is illustrated in FIGS. 6 through 9. Examples of this mechanism include the mechanism taught by Kokish in U.S. Pat. No. 6,651,478. or the mechanism marketed by Interface Associates Inc. (Model W8FH). In this type of mechanism, the working surfaces of the dies have a wedge shape with two planar surfaces meeting at the tip. The linear motion of the wedges in this mechanism provides a wedge-to-wedge gap that is constant, independent of the cavity diameter, and may be designed to be any desired size (see FIG. 10). A shortcoming of this mechanism is that it typically does not provide a sufficiently accurate positional relationship of the wedge-shaped working ends of the dies. Accurate positional relationship of the dies is important so that the central cavity remains approximately round and provides even compression around the circumference of the compressed device, and so that the largest die-to-die gaps aren't much larger than the average. Because each die is carried on its own linear guide, and all of the guides are attached to a plate or base, many parts and attachments may influence the accuracy (roundness) of the central cavity. Medical device manufacturing and testing often requires an accurately round cavity at diameters as small as 0.5 mm. which is typically not achieved by this type of mechanism.

A third type of radial compression mechanism includes several similarly shaped dies arranged to form an approximately cylindrical central cavity, the dies being hinged (or pivoted) and driven in unison to change the diameter of the cavity. The working die surfaces are not planar, but have a specifically-designed shape that makes the gap between adjacent dies an arbitrary function of diameter that may be chosen by the designer. Typically, the gap is chosen to be approximately constant, independent of diameter, and as small as manufacturing tolerances will allow. Usually, the hinge point of each die is located approximately on the opposite side of the mechanism from the working tip of the die resulting in concave working surfaces. Examples of this mechanism include the mechanism marketed by Blockwise Engineering (Model RJ). A shortcoming of this device is that geometry of each of the dies in the preferred embodiment is difficult to manufacture accurately in non-metallic materials. Non-metallic dies are often required to limit the scoring or abrasion on the compressed articles.

A fourth type of radial compression mechanism includes several similarly-shaped dies arranged to form an approximately cylindrical central cavity, each die having planar surfaces that form a wedge shape, the planar surfaces contacting and locating each die relative to its neighbors, and the dies being cammingly engaged with a common base member and driven in unison to change the diameter through the center of the central cavity (the center of the mechanism). With drive pins attached to the dies, the drive pins engage slots or surfaces on the disk. The disk may then be rotationally driven to open or close the central cavity. The shape of the slots or surfaces determines the relationship between the force applied to the compressed article and the die-to-die force. Generally, the slots or surfaces are designed such that a force applied to the compressed article results in a positive but nearly zero die-to-die force. One disadvantage of this mechanism is that the surfaces of the die are in sliding contact with adjacent dies. The stiction resulting from this contact can be problematic in applications that require either very accurate positioning or very accurate force readings. This problem is intensified if the dies are made from metallic materials since they generally have higher coefficients of friction.

It would be highly advantageous, therefore, to remedy the foregoing and other deficiencies inherent in the prior art.

Accordingly, it is an object of the present invention to provide a new and improved radial compression mechanism.

Another object of the invention is to provide a new and improved radial compression mechanism for compressing devices such as stents, catheters, balloons, and the like in the medical industry.

Another object of the invention is to provide a new and improved radial compression mechanism utilizing radially movable die that produce nearly zero die-to-die gaps.

Another object of the invention is to provide a new and improved radial compression mechanism utilizing radially movable die that produce a large usable size range.

Another object of the invention is to provide a new and improved radial compression mechanism utilizing radially movable die that exhibits low forces resulting from friction.

SUMMARY OF THE INVENTION

Briefly, to achieve the desired objects and advantages of the present invention in accordance with a preferred embodiment thereof a radial compression mechanism is disclosed that includes a housing defining an inner chamber and a central opening for insertion and removal of product. A plurality of elongated compression dies are movably mounted for reciprocal movement within the inner chamber and define a central product receiving cavity coaxial with the axis of the central opening. Cam followers are affixed to the dies. First cam surfaces are affixed relative to the housing and second cam surfaces are movably mounted relative to the housing. Each cam follower engages a first cam surface to define a first position control constraint, and a second cam surface to define a second position control constraint. Each die has a position relative to each adjacent die and the coaxial central cavity that is controlled by the first position control constraint and the second position control constraint.

The desired objects and advantages of the present invention are further achieved in accordance with a specific embodiment of a radial compression mechanism including a housing defining an inner chamber and a central opening with an axis. The central opening provides ingress along the axis for product to be compressed and egress along the axis for compressed product. A plurality of elongated compression dies are movably mounted by a plurality of bearings affixed to an inner surface of the housing and engage the plurality of dies adjacent an outer end. The plurality of elongated compression dies are mounted for reciprocal, substantially radial movement within the inner chamber and define a central product receiving cavity coaxial with the axis of the central opening. A plurality of cam followers is provided, with each die of the plurality of dies having a different cam follower affixed thereto. A plurality of first cam surfaces are affixed relative to the housing, the plurality of first cam surfaces being formed by a first plate affixed to the housing and defining a first plurality of oblong generally arcuately shaped openings arranged in a circle around the central opening. Each cam follower of each die engages a separate first cam surface of the plurality of first cam surfaces to define a first position control constraint. A plurality of second cam surfaces are movable relative to the housing, with the plurality of second cam surfaces being formed by a second plate rotatably mounted on the housing and defining a second plurality of oblong generally arcuately shaped openings arranged in a circle around the central opening. Each cam follower of each die engages a separate second cam surface of the plurality of second cam surfaces to define a second position control constraint. Each die has a position relative to each adjacent die and the coaxial central cavity that is controlled by the first position control constraint and the second position control constraint, and each die is reciprocally movable between a coaxial central cavity open orientation and a coaxial central cavity closed orientation by relative rotation of the second plate.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
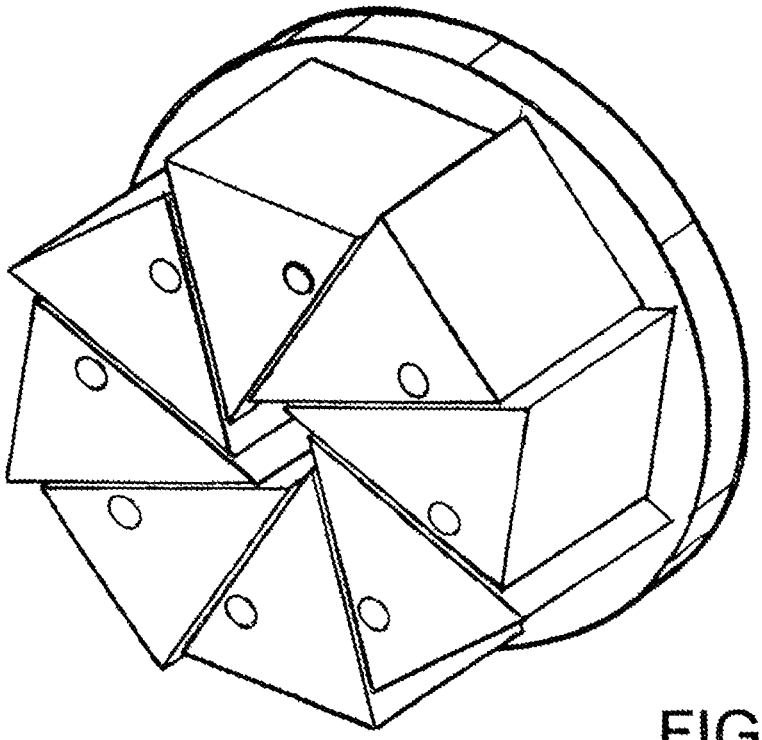
FIGS. 1-4 illustrate a first type of prior art radial compression mechanism.
Figure 2:
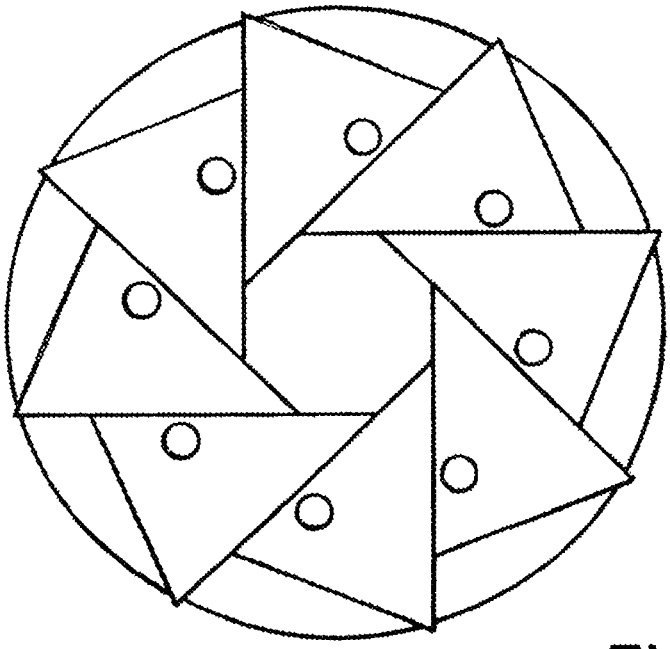
Figure 3:
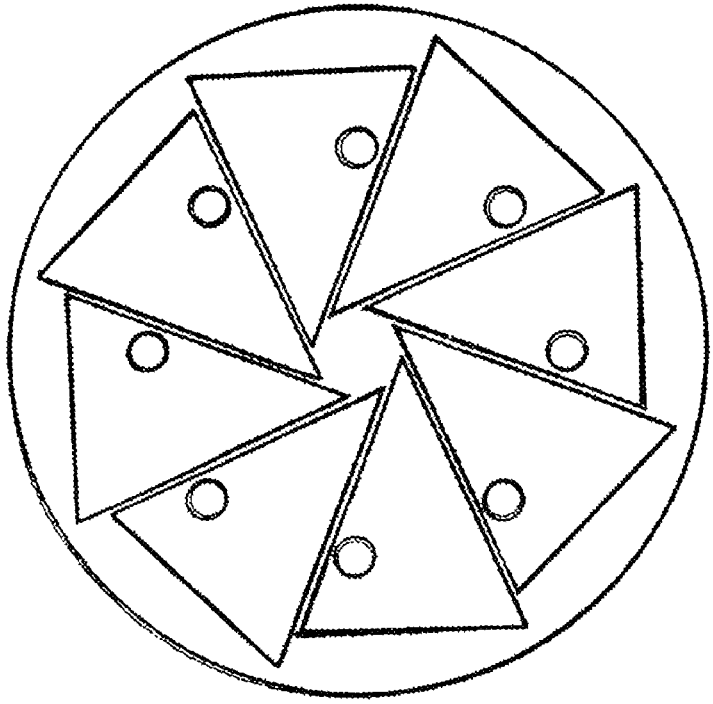
Figure 4:
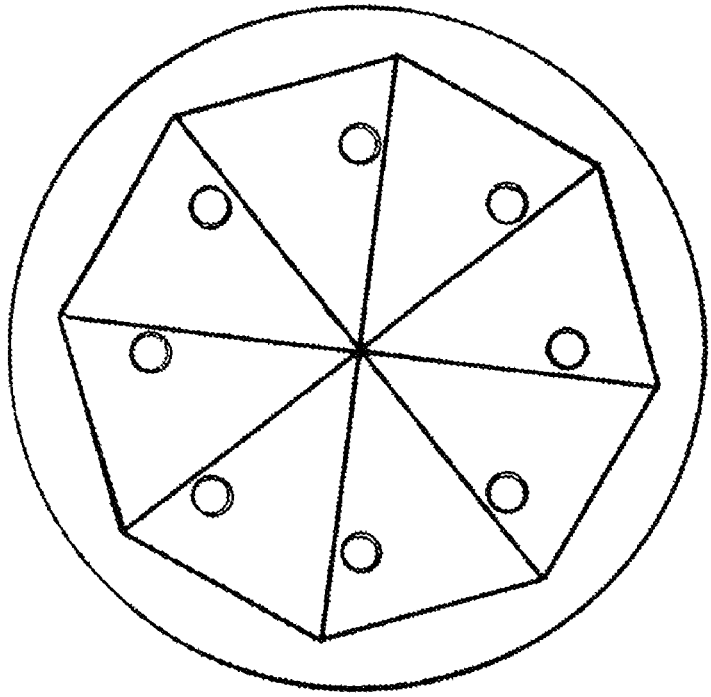
Figure 5:
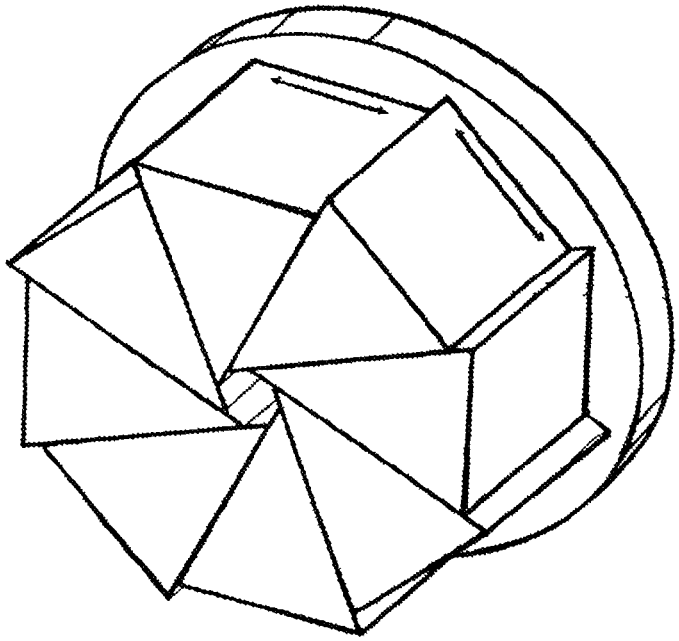
FIG. 5 illustrates graphically the relationship between the diameter of the central opening and die-to-die gaps for the embodiment of FIG. 1.
Figure 6:
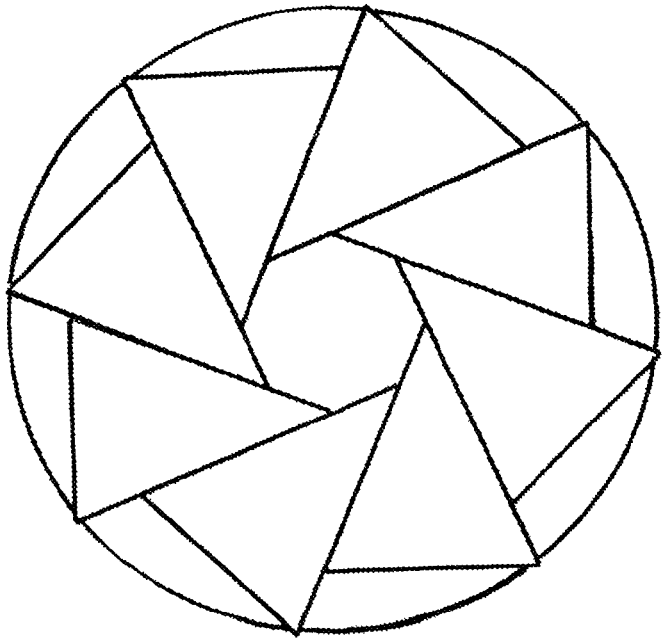
FIGS. 6-9 illustrate a second type of prior art radial compression mechanism with linear movement of the die.
Figure 7:
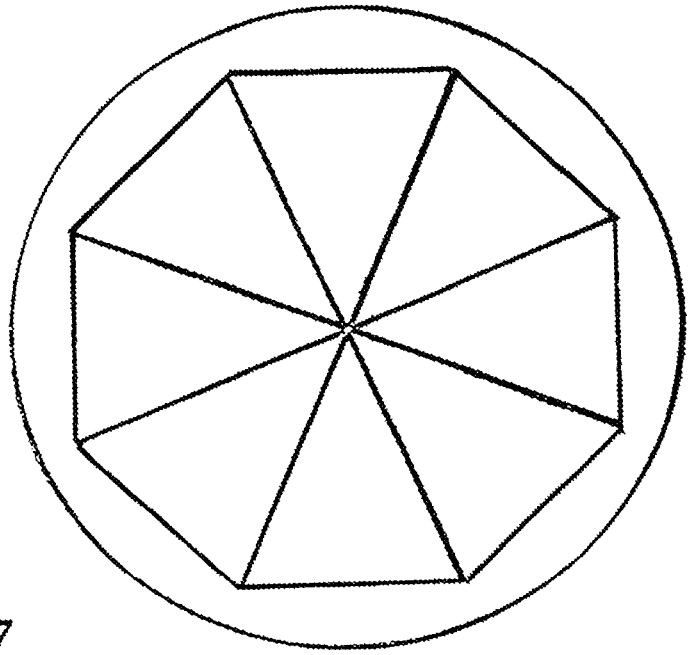
Figure 8:
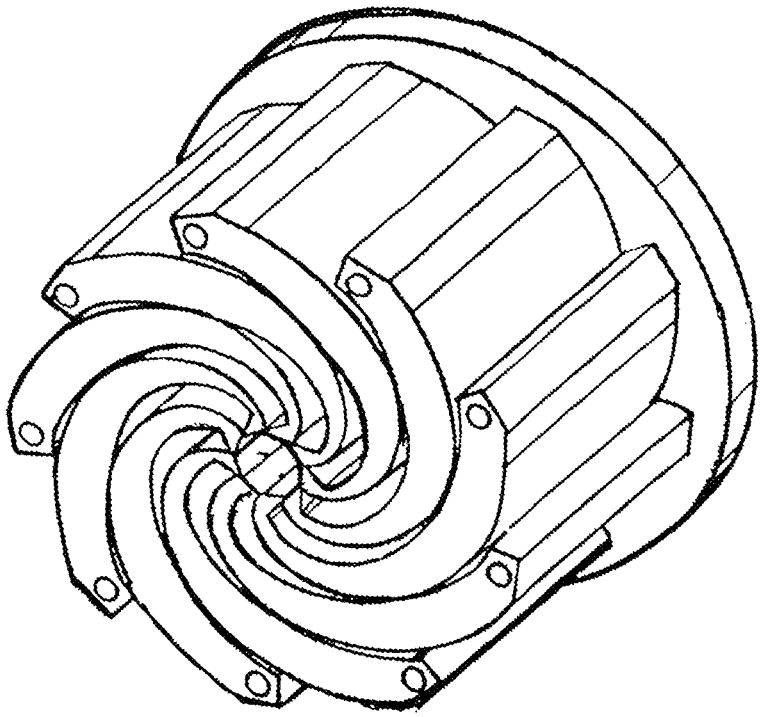
Figure 9:
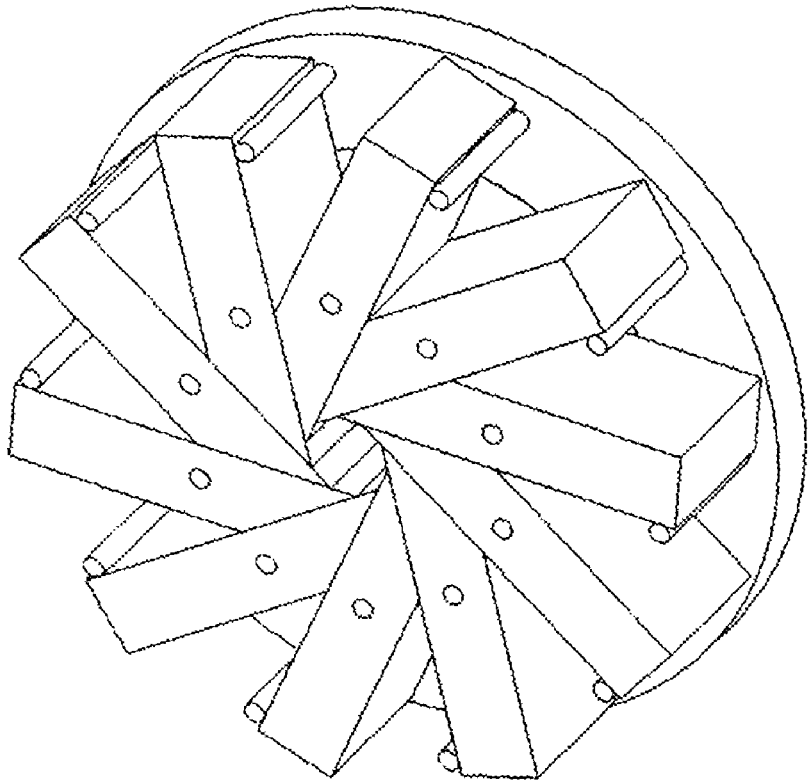
Figure 10:
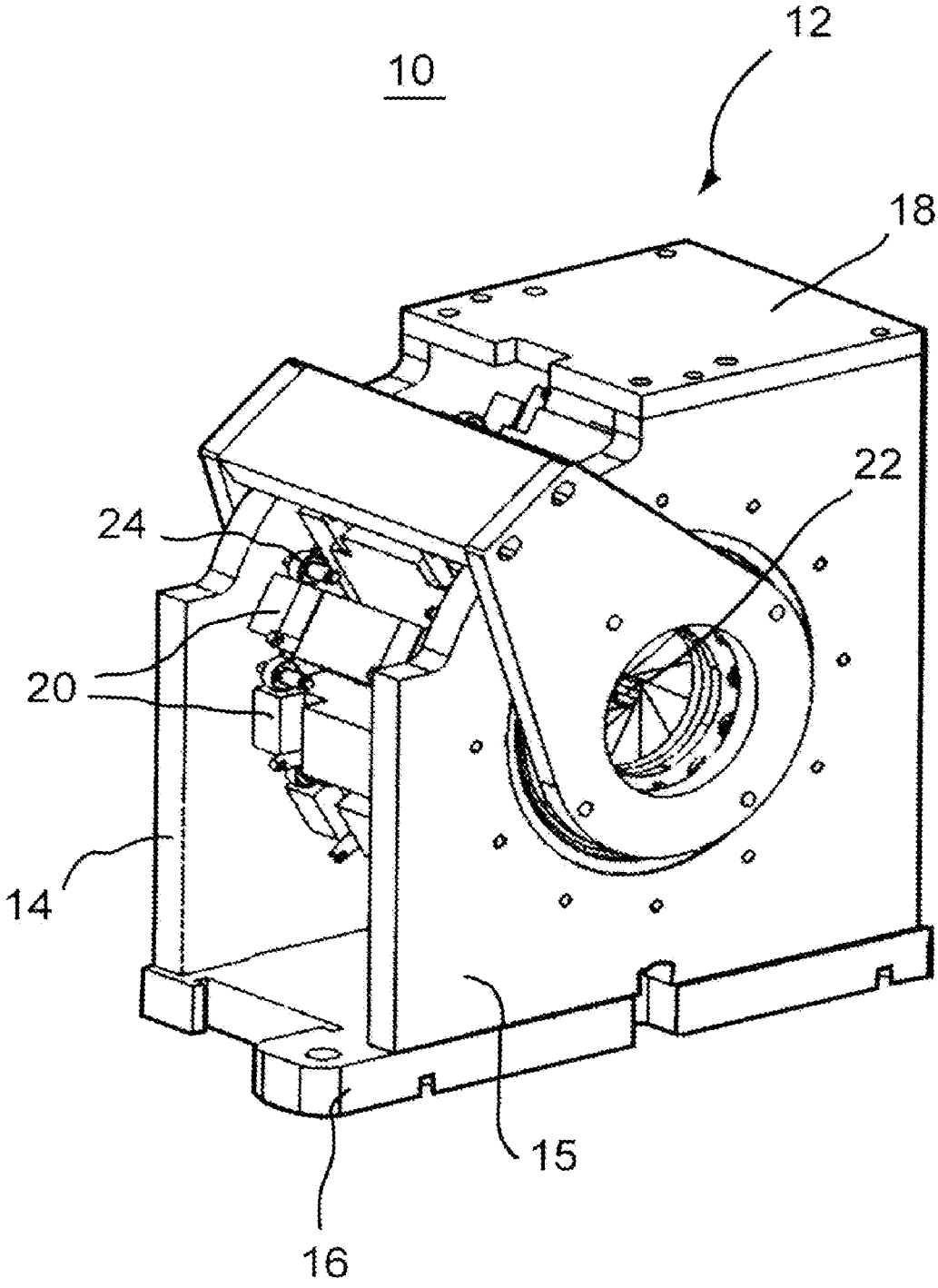
FIG. 10 is a perspective side view of a radial compression mechanism in accordance with the present invention.
Figure 11:
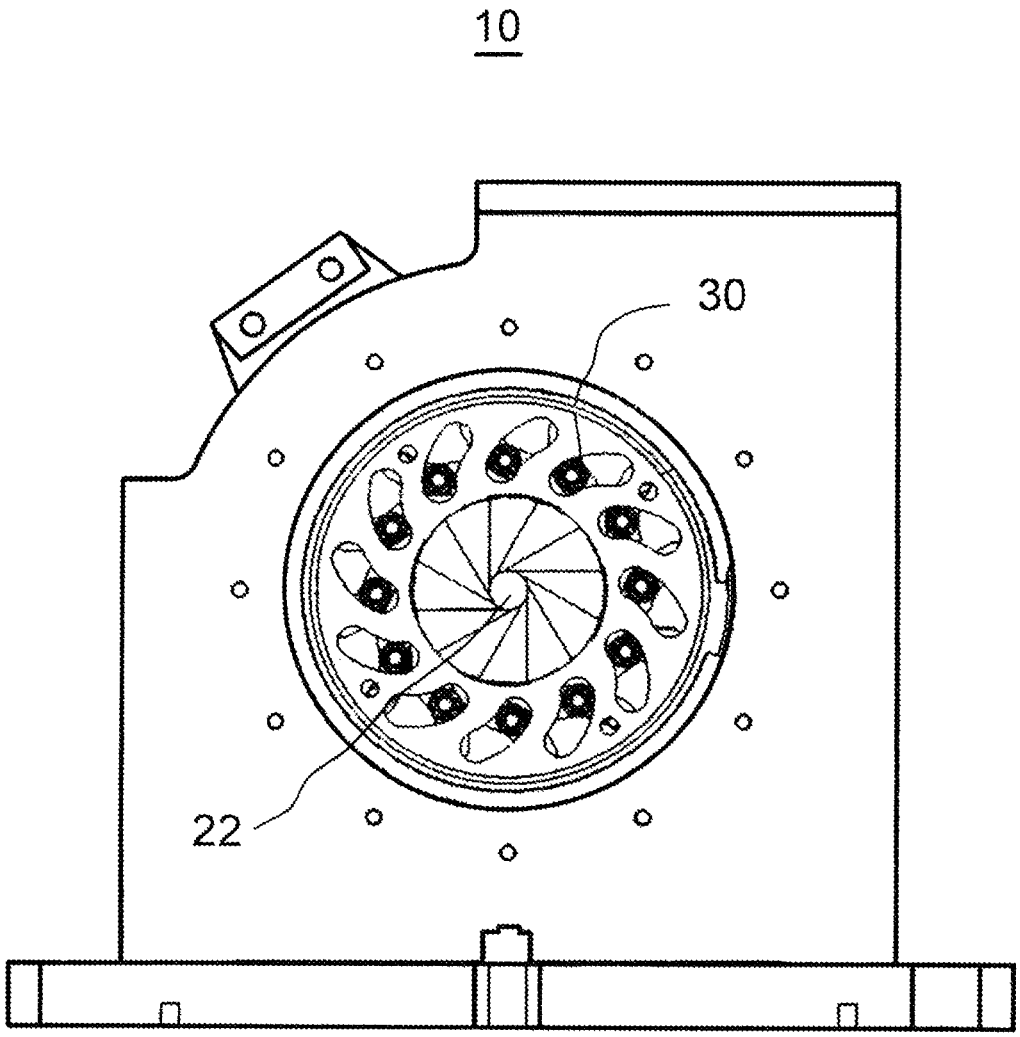
FIG. 11 is an enlarged side view of the radial compression mechanism of FIG. 10, with portions thereof removed.
Figure 12:
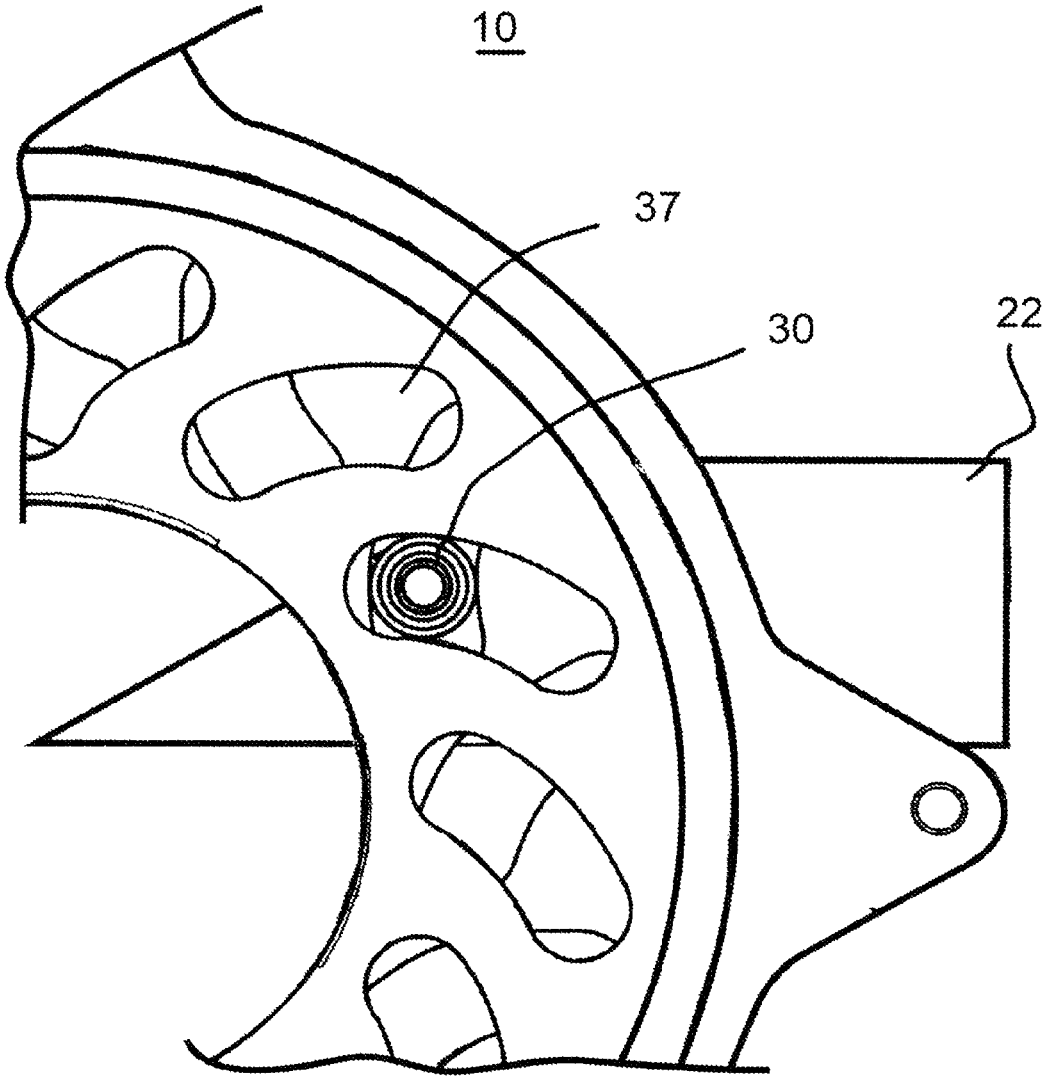
FIG. 12 is an enlarged side view of some inner moving parts of the radial compression mechanism of FIG. 10, portions thereof removed to provide the inner view.
Figure 13:
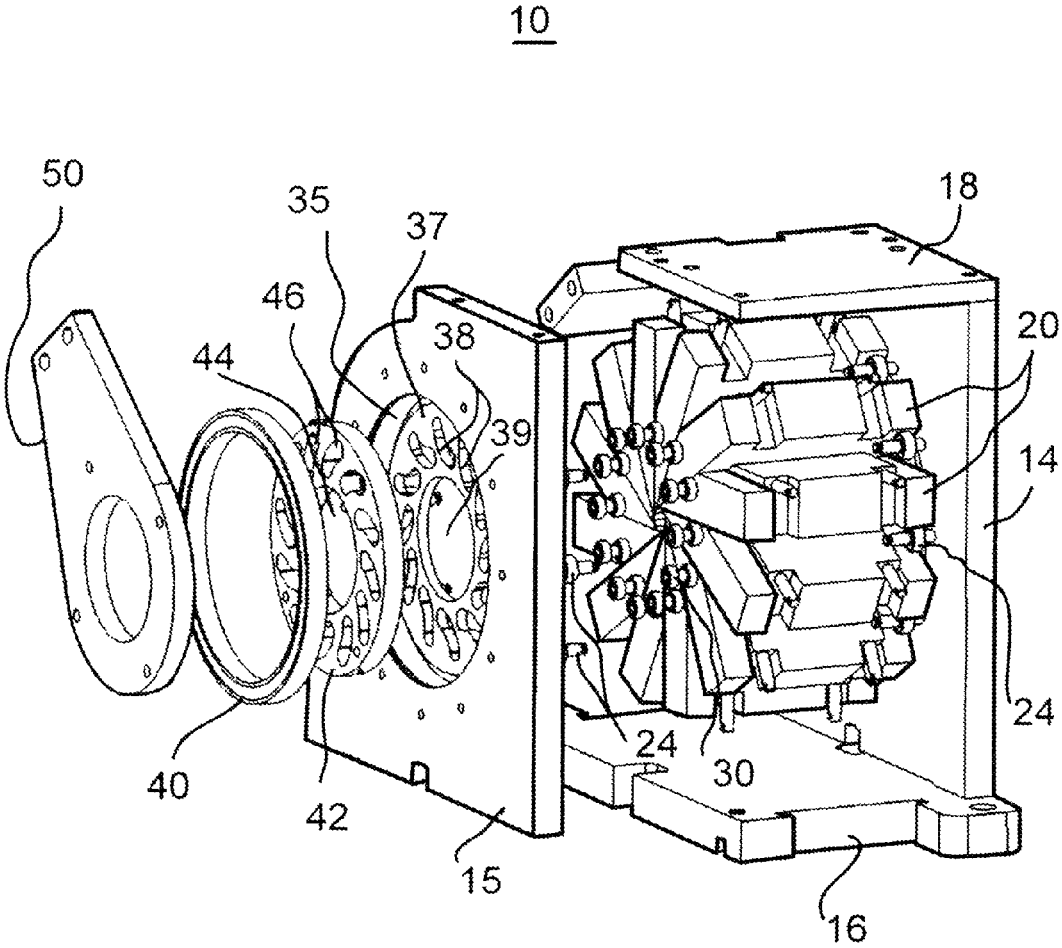
FIG. 13 is an exploded perspective view of the radial compression mechanism of FIG. 10.

Turning now to the drawings, attention is first directed to FIGS. 10-13, which illustrate various side and internal views of a radial compression mechanism 10 in accordance with the present invention. Mechanism 10 includes a support or base, hereinafter referred to as a housing, 12 with a pair of spaced apart side members 14 and 15 affixed in position by a base 16 and upper cross plates 18. A plurality of generally wedge shaped dies 20 are arranged within housing 12 to form an approximately cylindrical (in this embodiment) central cavity 22 for receiving product to be compressed. In this description it will be understood that the term "product" generally means some medical item such as medical stents, balloons, catheters and the like, but could include other items. Dies 20 are positioned between side members 14 and 15 within housing 12 for generally radial movements by rollers or bearings 24 extending inwardly from each side member 14 and 15 into housing 12 and between adjacent dies 20. It will be understood from the disclosure that the number of dies 20 may vary over a practical range of 3 to 20 dies.

Each die 20 also has a cam following pin 30 attached to the surface of the die adjacent side member 15. Cam following pins 30 may include bearing surfaces, rollers, or other features to reduce friction and the force required to move the associated or attached die 20. Generally, as will become clearer from the following description, cam following pins 30 include two axially spaced apart bearing surfaces or rollers (best seen in FIG. 13) that are positioned to follow two separate cam surfaces. Also, in this embodiment, cam following pins 30 are arranged in a circle generally coaxial with central cavity 22 and extend axially outwardly from dies 20.

Side member 15 has an opening 35 formed therein that is positioned coaxially around central cavity 22 in the assembled orientation. The diameter of opening 35 is sufficient to allow cam following pins 30 to extend therethrough. A first cam plate 37 is affixed within opening 35 adjacent to the inner surface of side member 15. Cam plate 37 can be affixed to side member 15 or formed as a part thereof. Further, cam plate 37 has a plurality of oblong, generally arcuately shaped openings 38 therethrough arranged in a circle around a central opening 39. Central opening 39 is coaxial with central cavity 22 and provides access thereto for inserting and retrieving product. Openings 38 are formed to arc generally outwardly and in a counterclockwise direction and are further positioned to each receive one cam following pin 30 therethrough. As will be understood from the following description, openings 38 form first cam surfaces for the engagement and movement of cam following pins 30 and, ultimately, dies 20. The engagement of each cam following pin 30 with the cam following surface of a separate opening 38 provides a first position control constraint. Here it should be understood that a first or inner one of the two axially spaced apart bearing surfaces or rollers on each cam following pin 30 is positioned to engage an opening 38.

It should be understood that first cam plate 37 is positioned to allow the major portion (axially) of opening 35 to receive a circular bearing 40 therein for rotatably mounting a second cam plate 42 within opening 35. Cam plate 42 has a central opening 44 therethrough that is coaxially positioned relative to central cavity 22 and provides access thereto for inserting and retrieving product. Also, cam plate 42 has a plurality of oblong, generally arcuately shaped openings 46 therethrough arranged in a circle around central opening 44. Openings 46 are formed to arc generally outwardly and in a direction generally opposite to the arcing direction of openings 38 and are also positioned to each receive one cam following pin 30 therethrough. As will be understood, openings 46 form second cam surfaces for the engagement and movement of cam following pins 30 and, ultimately, dies 20. The engagement of each cam following pin 30 with the cam following surface of a separate opening 46 provides a second position control constraint. Here it should be understood that a second or outer one of the two axially spaced apart bearing surfaces or rollers on each cam following pin 30 is positioned to engage an opening 46.

An actuation arm 50 is attached to cam plate 42 to provide rotary movement of cam plate 42 relative to cam plate 37. Because of the formation of openings 38 and 46, as cam plate 42 is rotated relative to cam plate 37 cam following pins 30 move dies 20 inwardly for rotation in one direction and outwardly for rotation in the opposite direction. It should be noted that the position of each die 20 relative to the position of each adjacent die 20 and the inner chamber is controlled by a combination of the first position control constraint and the second position control constraint. While all of the first and second position control constraints are illustrated in this embodiment as similar and the inner chamber is illustrated as cylindrical, it should be understood that at least some of the control constraints could be changed, for example, to define a different shaped inner chamber. In such applications the die can be designed to move in non-uniform movements and may be further designed to perform selected functions other than compression, such as pleating or forming pleats and/or gripping and holding the product.

A primary advantage of mechanism 10 is that the position of each die 20 is controlled by the relative position of each of the cam surfaces (i.e., openings 38 and 46). Because cam following pins 30 are always in contact with the cam surfaces formed by openings 38 and 46, dies 20 do not actually bear on adjacent die but are held in position by cam following pins 30. For example, the gap between each of adjacent dies 20 is an arbitrary function of the diameter of mechanism 10 and can be designed to follow any desired function. In a preferred embodiment, the gaps between adjacent dies 20 are designed to be constant as a function of diameter and as small as manufacturing tolerances allow. An advantage of mechanism 10 over the first type of prior art (described above) is that there is no tradeoff between die-to-die gaping and the usable range of the diameter of central cavity 22. Therefore, mechanism 10 can be designed with a relatively large diameter range for a given overall machine envelope.

It will be noted that the axis through each cam following pin 30 is such that the cam following engagement between dies 20 and cam plate 37 is shared by the cam following engagement with cam plate 42. In this manner mechanism 10 is simplified by reducing the number of accurate features that need to be produced. It will be understood that the power to drive cam plate 42 (in this description actuation arm 50) may be provided from a variety of sources, for example, human muscles, an electric motor, or a fluid-powered motor.

An advantage of mechanism 10 over the third type of mechanism (described above) is that the geometry of dies 20 is much simpler to produce using conventional machining methods. Because of this feature, dies 20 can be made from metallic and/or non-metallic materials. An advantage of mechanism 10 over the fourth type of mechanism (described above) is that if rolling type bearings are used in the camming engagements (the two axially spaced apart bearing surfaces or rollers on each cam following pin 30), there are no sliding surfaces to cause stiction and high frictional losses. This allows mechanism 10 to be used in applications that require either very accurate positioning or very accurate force measurements.

Another embodiment in accordance with the present invention also includes several dies arranged to form a central cavity, the dies being cammingly engaged with a common base member or cam plate at two constraints and driven in unison to change the diameter of the central cavity with a second base member or cam plate that is cammingly engaged to the dies and is rotated about an axis through the center of the central cavity, and the dies also being cammingly engaged to a third base member that is rotated about an axis through the center of the central cavity. In a preferred embodiment, the second and third base members or cam plates are combined to form a base member with two camming engagements per die. Also, the axis of the cam followers can be combined to simplify manufacturing with the result being that the position of each die is controlled at two points, the position of which is defined by the geometry of the cam surfaces.

An advantage of this embodiment is the position of each of the dies is a completely arbitrary function. For example, the central cavity could be designed to be a non-cylindrical shape like an oval or pear shape. The dies could be designed to move in a non-uniform fashion, for example, two of the dies could rapidly extend to hold the product while the remaining dies form a desired feature in the product.

Thus, a new and novel radial compression mechanism has been disclosed. The new and novel radial compression mechanism is constructed to operate with a constant gap between adjacent die and to move the die in unison between a maximum diameter central cavity and a minimum diameter central cavity with a continuous radial movement. Therefore, the changing and relatively large gap of some prior art devices or the extremely difficult linear movement of other prior art devices has been overcome.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. Radial compression mechanism comprising:

a plurality of elongated compression dies movably mounted for reciprocal movement and defining a central product receiving cavity;

a plurality of cam followers with each die of the plurality of dies having a different cam follower of the plurality of cam followers associated therewith;

a plurality of first curved cam surfaces affixed relative to the plurality of dies, each cam follower associated with each die engaging a separate first curved cam surface of the plurality of first curved cam surfaces to define a first position control constraint;

a plurality of second curved cam surfaces movable relative to the first curved cam surfaces, each cam follower associated with each die engaging a separate second curved cam surface of the plurality of second curved cam surfaces to define a second position control constraint;

each die having a position relative to each adjacent die and the central product receiving cavity that is controlled by the first position control constraint and the second position control constraint; and whereby reciprocal movement of each die associated with each cam follower is non-linear as each cam follower moves along the separate first curved cam surface and the separate second curved cam surface.

2. Radial compression mechanism as claimed in claim 1 wherein each die of the plurality of dies is positioned adjacent but spaced from each adjacent die, the spacing being constant as a function of diameter of the central product receiving cavity.

3. Radial compression mechanism as claimed in claim 2 wherein the spacing between adjacent dies is as small as manufacturing tolerances allow.

4. Radial compression mechanism as claimed in claim 2 wherein the plurality of dies are formed of one of metallic and non-metallic material.

5. Radial compression mechanism as claimed in claim 1 further including a housing defining an inner chamber and a central opening with an axis, the central opening providing ingress along the axis for product to be compressed and egress along the axis for compressed product and the central product receiving cavity is coaxial with the central opening.

6. Radial compression mechanism as claimed in claim 5 wherein the plurality of first curved cam surfaces are formed by a first plate affixed to the housing and defining a first plurality of oblong, generally arcuately shaped openings arranged in a circle around the central opening.

7. Radial compression mechanism as claimed in claim 6 wherein the plurality of second curved cam surfaces are formed by a second plate rotatably mounted on the housing and defining a second plurality of oblong, generally arcuately shaped openings arranged in a circle around the central opening.

8. Radial compression mechanism as claimed in claim 7 wherein the first plurality of oblong, generally arcuately shaped openings are positioned to arc outwardly from the central opening one of generally clockwise and generally counterclockwise and the second plurality of oblong, generally arcuately shaped openings are positioned to arc outwardly from the central opening another of generally counterclockwise and generally clockwise.

9. Radial compression mechanism as claimed in claim 7 wherein the plurality of cam followers are affixed to the plurality of dies adjacent an inner end and the mechanism further including a plurality of bearings affixed to an inner surface of the housing and engaging the plurality of dies adjacent an outer end.

10. Radial compression mechanism as claimed in claim 7 wherein the plurality of elongated compression dies are generally wedge shaped with a point at an inner end defining the central product receiving cavity.

11. Radial compression mechanism as claimed in claim 10 wherein the plurality of elongated generally wedge shaped compression dies are elongated to form a longitudinally extending central product receiving cavity coaxial with the axis of the central opening.

12. Radial compression mechanism as claimed in claim 1 wherein the first and the second position control constraints are designed to move the plurality of elongated generally wedge shaped compression dies in a substantially radial uniform movement.

13. Radial compression mechanism as claimed in claim 1 wherein the first and the second position control constraints are designed to move the plurality of elongated generally wedge shaped compression dies in a substantially non-uniform movement varying from die-to-die.

14. Radial compression mechanism as claimed in claim 1 wherein the plurality of dies are shaped to perform a predetermined function other than compression.

15. Radial compression mechanism comprising:

a housing defining an inner chamber and a central opening with an axis, the central opening providing ingress along the axis for product to be compressed and egress along the axis for compressed product;

a plurality of elongated compression dies movably mounted by a plurality of bearings affixed to an inner surface of the housing and engaging the plurality of dies adjacent an outer end, the plurality of elongated compression dies being mounted within the inner chamber and defining a central product receiving cavity coaxial with the axis of the central opening, the plurality of dies being mounted for reciprocal, substantially radial movement about the coaxial central cavity;

a plurality of cam followers with each die of the plurality of dies having a different cam follower of the plurality of cam follower affixed thereto;

a plurality of first curved cam surfaces affixed relative to the housing, the plurality of first curved cam surfaces being formed by a first plate affixed to the housing and defining a first plurality of oblong generally arcuately shaped openings arranged in a circle around the central opening, each cam follower of each die engaging a separate first curved cam surface of the plurality of first curved cam surfaces to define a first position control constraint;

a plurality of second curved cam surfaces movable relative to the housing, the plurality of second curved cam surfaces being formed by a second plate rotatably mounted on the housing and defining a second plurality of oblong generally arcuately shaped openings arranged in a circle around the central opening, each cam follower of each die engaging a separate second curved cam surface of the plurality of second curved cam surfaces to define a second position control constraint;

each die having a position relative to each adjacent die and the coaxial central cavity that is controlled by the first position control constraint and the second position control constraint, and each die being reciprocally movable between a coaxial central cavity open orientation and a coaxial central cavity closed orientation by relative rotation of the second plate; and whereby reciprocal movement of each die associated with each cam follower is non-linear as each cam follower moves along the separate first curved cam surface and the separate second curved cam surface.

16. Radial compression mechanism as claimed in claim 15 wherein each die of the plurality of dies is positioned adjacent but spaced from each adjacent die, the spacing being constant as a function of diameter of the coaxial central cavity.

17. Radial compression mechanism as claimed in claim 15 wherein the spacing between adjacent dies is as small as manufacturing tolerances allow.

18. Radial compression mechanism as claimed in claim 15 wherein the plurality of dies are formed of one of metallic and non-metallic material.

19. Radial compression mechanism as claimed in claim 15 wherein the plurality of elongated generally wedge shaped compression dies are elongated to form a longitudinally extending central product receiving cavity coaxial with the axis of the central opening.

20. A method of compressing products in a radial compression mechanism comprising the steps of:

providing a radial compression mechanism including a housing defining an inner chamber, a plurality of elongated compression dies movably mounted for reciprocal, substantially radial movement within the inner chamber and defining a central product receiving cavity, a plurality of cam followers with each die of the plurality of dies having a different cam follower of the plurality of cam follower affixed thereto, a plurality of first curved cam surfaces affixed relative to the housing, each cam follower of each die engaging a separate first curved cam surface of the plurality of first curved cam surfaces to define a first position control constraint, and a plurality of second curved cam surfaces movable relative to the housing, each cam follower of each die engaging a separate second curved cam surface of the plurality of second curved cam surfaces to define a second position control constraint, whereby reciprocal movement of each die associated with each cam follower is non-linear as each cam follower moves along the separate first curved cam surface and the separate second curved cam surface;

moving the plurality of dies into an open cavity orientation by controlling the plurality of second curved cam surfaces;

inserting a product coaxially into the open cavity;

compressing a product by moving the plurality of dies into a closed cavity orientation by controlling the plurality of second curved cam surfaces; and moving the plurality of dies into the open cavity orientation and removing the compressed product from the central cavity.

* * * * *